US009489954B2

(12) United States Patent
Hooks et al.

(10) Patent No.: US 9,489,954 B2
(45) Date of Patent: Nov. 8, 2016

(54) ENCODING AND RENDERING OF OBJECT BASED AUDIO INDICATIVE OF GAME AUDIO CONTENT

(71) Applicant: DOLBY LABORATORIES LICENSING CORPORATION, San Francisco, CA (US)

(72) Inventors: S. Spencer Hooks, San Mateo, CA (US); Nicolas R. Tsingos, Palo Alto, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/414,877

(22) PCT Filed: Aug. 6, 2013

(86) PCT No.: PCT/US2013/053750

§ 371 (c)(1),
(2) Date: Jan. 14, 2015

(87) PCT Pub. No.: WO2014/025752

PCT Pub. Date: Feb. 13, 2014

(65) Prior Publication Data

US 2015/0235645 A1 Aug. 20, 2015

Related U.S. Application Data

(60) Provisional application No. 61/680,559, filed on Aug. 7, 2012, provisional application No. 61/860,357, filed on Jul. 31, 2013.

(51) Int. Cl.
*G10L 19/008* (2013.01)
*H04S 7/00* (2006.01)

(52) U.S. Cl.
CPC ..... *G10L 19/008* (2013.01); *H04S 7/00* (2013.01); *H04S 2400/01* (2013.01)

(58) Field of Classification Search
CPC ..... G10L 19/20
See application file for complete search history.

(56) References Cited

U.S. PATENT DOCUMENTS 7,027,600 B1 * 4/2006 Kaji ..... A63F 13/10 345/419
8,204,756 B2 * 6/2012 Kim ..... G10L 19/008 381/2

(Continued)

FOREIGN PATENT DOCUMENTS

JP 2011-501544 1/2011
JP 2011-509591 3/2011

(Continued)

OTHER PUBLICATIONS

Terentiev, Leonid, et al. "SAOC for Gaming—The Upcoming MPEG Standard on Parametric Object Based Audio Coding." Audio Engineering Society Conference: 35th International Conference: Audio for Games. Audio Engineering Society, 2009.*

(Continued)

*Primary Examiner* — Brian Albertalli

(57) ABSTRACT

In some embodiments, a method (typically performed by a game console) for generating an object based audio program indicative of game audio content (audio content pertaining to play of or events in a game, and optionally also other information regarding the game), and including at least one audio object channel and at least one speaker channel. In other embodiments, a game console configured to generate such an object based audio program. Some embodiments implement object clustering in which audio content of input objects is mixed to generate at least one clustered audio object, or audio content of at least one input object is mixed with speaker channel audio. In response to the program, a spatial rendering system (e.g., external to the game console) may operate with knowledge of playback speaker configuration to generate speaker feeds indicative of a spatial mix of the program's speaker and object channel content.

20 Claims, 4 Drawing Sheets

(56) References Cited

U.S. PATENT DOCUMENTS

| | | | | |
|---|---|---|---|---|
| 8,515,759 | B2 * | 8/2013 | Engdegard | 704/220 |
| 8,687,829 | B2 * | 4/2014 | Hilpert | 381/1 |
| 2005/0114121 | A1 | 5/2005 | Tsingos | |
| 2008/0049943 | A1 | 2/2008 | Faller | |
| 2009/0067634 | A1 * | 3/2009 | Oh | H04S 3/008 381/17 |
| 2010/0014692 | A1 | 1/2010 | Schreiner | |
| 2010/0114582 | A1 | 5/2010 | Beack | |
| 2010/0223552 | A1 | 9/2010 | Metcalf | |
| 2011/0022402 | A1 * | 1/2011 | Engdegard | H04S 7/30 704/501 |
| 2011/0040395 | A1 | 2/2011 | Kraemer | |
| 2011/0040396 | A1 * | 2/2011 | Kraemer | G10L 19/00 700/94 |
| 2011/0060599 | A1 * | 3/2011 | Kim | H04S 7/30 704/501 |
| 2011/0069934 | A1 | 3/2011 | Lee | |
| 2011/0182432 | A1 * | 7/2011 | Ishikawa | G10L 19/008 381/22 |
| 2011/0202357 | A1 | 8/2011 | Kim | |
| 2012/0183162 | A1 | 7/2012 | Chabanne | |
| 2012/0269353 | A1 * | 10/2012 | Herre | G10L 19/008 381/22 |
| 2014/0023197 | A1 * | 1/2014 | Xiang | H04S 1/007 381/17 |
| 2014/0025386 | A1 * | 1/2014 | Xiang | G10L 19/008 704/500 |
| 2014/0297296 | A1 * | 10/2014 | Koppens | G10L 19/008 704/500 |
| 2014/0350944 | A1 * | 11/2014 | Jot | G10L 19/008 704/500 |
| 2014/0358567 | A1 * | 12/2014 | Koppens | G10L 19/008 704/500 |
| 2015/0142453 | A1 * | 5/2015 | Oomen | G10L 19/008 704/500 |

FOREIGN PATENT DOCUMENTS

| | | |
|---|---|---|
| JP | 2011-528200 | 11/2011 |
| RS | 1332 U | 2/2013 |
| WO | 2007/076346 | 7/2007 |
| WO | 2008/063034 | 5/2008 |
| WO | 2014/035864 | 3/2014 |
| WO | 2014/099285 | 6/2014 |

OTHER PUBLICATIONS

Herre, Jürgen, et al. "MPEG Spatial Audio Object Coding—the ISO/MPEG standard for efficient coding of interactive audio scenes." Journal of the Audio Engineering Society 60.9 (2012): 655-673.*

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

ENCODING AND RENDERING OF OBJECT BASED AUDIO INDICATIVE OF GAME AUDIO CONTENT

CROSS-REFERENCE TO RELATED APPLICATIONS

This application claims priority to U.S. Provisional Patent Application Nos. 61/580,559 filed 7 Aug. 2012 and 61/860,357 filed 31 Jul. 2013, which is hereby incorporated by reference in its entirety.

TECHNICAL FIELD

The invention pertains to audio signal processing, and more particularly to encoding and rendering of audio data bitstreams which include at least one audio object channel and object-related metadata as well as speaker channels, and are indicative of audio content of games. Some embodiments are game consoles configured to generate such an encoded audio data bitstream. Some embodiments generate, decode, and/or render audio data in one of the formats known as Dolby Digital (AC-3) or Dolby Digital Plus (Enhanced AC-3 or E-AC-3).

BACKGROUND

Dolby, Dolby Digital, and Dolby Digital Plus are trademarks of Dolby Laboratories Licensing Corporation. Dolby Laboratories provides proprietary implementations of AC-3 and E-AC-3 known as Dolby Digital and Dolby Digital Plus, respectively.

Audio is a critical component in the experience of playing video games and the art of producing game sound has become more and more sophisticated as the industry has grown. Game sound in current generation games is produced using audio objects, which are processed in a game console to generate a speaker channel-based program (sometimes referred to as a speaker channel-based "mix"). The mix, which comprises a number of speaker channels, is typically encoded (e.g., as an AC-3 or E-AC-3 bitstream) and the encoded audio is delivered to a rendering system. To implement playback, the rendering system generates speaker feeds in response to the speaker channels indicated by the encoded audio. FIG. 1 is a block diagram of audio processing elements of a typical conventional game console (one of the current generation of game consoles).

Typically, many of the sounds heard in a conventional game are stored as individual mono files (except some ambience and music tracks, which are typically stored as 2-channel or 5-channel files), and accesses to these files are triggered by events which occur during game play. The audio data labeled "Audio Assets" in FIG. 1 are examples of such stored audio files. Typical game consoles include an audio engine (e.g., game audio engine 1 of the FIG. 1 system) which is configured to manage a library of stored audio files, to monitor game state/user input, to play appropriate ones of the audio files at appropriate times, to position the accessed sounds accordingly (so that they will be perceived as emitting from appropriate locations during playback), and then finally to generate a speaker channel-based mix (e.g., the 5.1 speaker channel PCM audio output from engine 1 of FIG. 1). Game consoles typically also include an audio mixer (e.g., game console audio mixer 3 of the FIG. 1 system) which is coupled and configured to supplement the speaker channel-based mix with system sounds, alerts, additional music (and optionally other audio content). Game consoles typically also include an encoder (e.g., encoder 5 of the FIG. 1 system) which is coupled and configured to encode (in real-time) the modified (mixed) speaker channel-based mix (e.g., the 5.1 speaker channel PCM output from mixer 3 of FIG. 1) to generate an encoded audio bitstream (e.g., the encoded bitstream having AC-3 format which is output from encoder 5 of FIG. 1) for delivery (typically, transmission by an S/PDIF link) to a rendering system for rendering. Encoder 5 of the FIG. 1 system may be implemented as a conventional "Dolby Digital Live" encoder which outputs an encoded AC-3 bitstream in response to 5.1 speaker channel PCM audio from mixer 3.

Often during conventional game audio generation, much of the spatial information of the original object-based audio content (e.g., the Audio Assets of the FIG. 1 system) is lost when creating a speaker channel-based mix (e.g., the speaker channel-based mix output from engine 1 or mixer 3 of FIG. 1, which comprises speaker channels but not any object channel, or the encoded version of the speaker channel-based mix which is output from encoder 5 of FIG. 1, which is also indicative of speaker channels but not any object channel). The final listener experience is also compromised when the final playback system does not precisely render the speaker channel-based mix. The inventors have recognized that it would be desirable to include in the encoded audio which is generated by a game console (and output from the console for rendering) not only speaker channels, but also at least one object channel indicative of at least one audio object (e.g., indicative of stored audio content which is read from a file or otherwise accessed in response to an event occurring during game play) and descriptive information (metadata) regarding at least one such audio object (e.g., the positional trajectory and perceived size of each audio object as a function of time during playback). Thus, typical embodiments of the inventive game console are configured to generate an object based audio program (indicative of game audio content), and typically also to output the program for delivery to an external spatial rendering system (e.g., device) having knowledge of the playback system speaker configuration. Typically, the spatial rendering system employed to render the object based audio program is operable to generate speaker feeds indicative of an appropriate spatial mix of the program's speaker channel and object channel content.

It is known to employ high-end playback systems (e.g., in movie theaters) to render object based audio programs. For example, object based audio programs which are movie soundtracks may be indicative of many different sound elements (audio objects) corresponding to images on a screen, dialog, noises, and sound effects that emanate from different places on (or relative to) the screen, as well as background music and ambient effects (which may be indicated by speaker channels of the program) to create the intended overall auditory experience. Accurate playback of such programs requires that sounds be reproduced in a way that corresponds as closely as possible to what is intended by the content creator with respect to audio object size, position, intensity, movement, and depth.

Object based audio programs represent a significant improvement over traditional speaker channel-based audio programs, since speaker-channel based audio is more limited with respect to spatial playback of specific audio objects than is object channel based audio. Speaker channel-based audio programs consist of speaker channels only (not object channels), and each speaker channel typically determines a speaker feed for a specific, individual speaker in a listening environment.

Various methods and systems for generating and rendering object based audio programs have been proposed. During generation of an object based audio program, it is typically assumed that an arbitrary number of loudspeakers will be employed for playback of the program, and that the loudspeakers to be employed (typically, in a movie theater) for playback will be located in arbitrary locations in the playback environment; not necessarily in a (nominally) horizontal plane or in any other predetermined arrangement known at the time of program generation. Typically, object-related metadata included in the program indicates rendering parameters for rendering at least one object of the program at an apparent spatial location or along a trajectory (in a three dimensional volume), e.g., using a three-dimensional array of speakers. For example, an object channel of the program may have corresponding metadata indicating a three-dimensional trajectory of apparent spatial positions at which the object (indicated by the object channel) is to be rendered. The trajectory may include a sequence of "floor" locations (in the plane of a subset of speakers which are assumed to be located on the floor, or in another horizontal plane, of the playback environment), and a sequence of "above-floor" locations (each determined by driving a subset of the speakers which are assumed to be located in at least one other horizontal plane of the playback environment). Examples of rendering of object based audio programs are described, for example, in PCT International Application No. PCT/US2001/028783, published under International Publication No. WO 2011/119401 A2 on Sep. 29, 2011, and assigned to the assignee of the present application.

The advent of object based audio program rendering has significantly increased the amount of the audio data processed and the complexity of rendering that must be performed by rendering systems, in part because an object based audio program may be indicative of many objects (each with corresponding metadata) and may be rendered for playback by a system including many loudspeakers. It has been proposed to limit the number of object channels included in an object based audio program so that an intended rendering system has capability to render the program. For example, U.S. Provisional Patent Application No. 61/745,401, entitled "Scene Simplification and Object Clustering for Rendering Object-based Audio Content," filed on Dec. 21, 2012, naming Brett Crockett, Alan Seefeldt, Nicolas Tsingos, Rhonda Wilson, and Jeroen Breebaart as inventors, and assigned to the assignee of the present invention, describes methods and apparatus for so limiting the number of object channels of an object based audio program by clustering input object channels to generate clustered object channels which are included in the program and/or by mixing audio content of input object channels with speaker channels to generate mixed speaker channels which are included in the program.

BRIEF DESCRIPTION OF THE INVENTION

In a class of embodiments, the invention is a method (typically performed by a game console) for generating an object based audio program indicative of game audio content (audio content pertaining to play of or events in a game, and optionally also other information regarding the game). The program includes at least one audio object channel and at least one speaker channel (e.g., a set or "bed" of speaker channels). Each object channel is indicative of an audio object or set (e.g., mix or cluster) of audio objects, and typically includes corresponding object-related metadata. The bed of speaker channels may be a conventional mix (e.g., a 5.1 channel mix) of speaker channels of a type that might be included in a conventional speaker channel-based broadcast program which does not include an object channel. Typically, the method includes a step of generating audio data indicative of the set of speaker channels and each said object channel, and encoding the audio data to generate the object based audio program. In some embodiments, the object based audio program is an AC-3 or E-AC-3 bitstream. In response to an object based audio program generated by typical embodiments in this class, a spatial rendering system (e.g., a subsystem of the game console, or a system external to the game console) may generate speaker feeds which are indicative of a mix of audio content of each speaker channel and each object channel. It is contemplated that the inventive method is typically performed by a game console, and that the spatial rendering system is typically external to the game console and is operable with knowledge of the playback system speaker configuration to generate the speaker feeds such that the speaker feeds are indicative of an appropriate spatial mix of the program's speaker channel and object channel content.

In some embodiments, the inventive method includes steps of:

(a) identifying a set of input audio objects which are indicative of game audio content (audio content pertaining to play of or events in a game, and optionally also other information regarding the game) to be included in the object based audio program, where the set consists of N input audio objects, and N is greater than one;

(b) replacing the set of input audio objects (e.g., by mixing audio content of at least one input audio object of the set) with a reduced set of audio objects (and optionally also at least one mixed speaker channel), where the reduced set consists of M audio objects, and M is a positive integer less than N; and (c) generating the object based audio program such that said object based audio program is indicative of the reduced set of audio objects, includes only M object channels, and includes at least one speaker channel.

Step (b) may include one or both of the steps of:

mixing audio content of at least two of the input audio objects to generate at least one clustered audio object; or mixing audio content of at least one of the input audio objects with audio content of a speaker channel to generate at least one mixed speaker channel.

In some embodiments, step (b) includes steps of defining an error threshold for at least one parameter indicated by metadata associated with each input audio object of the set of input audio objects, and identifying as one of the reduced set of audio objects (and thus mixing audio content of) each input audio object of the set which is associated with metadata for which the at least one parameter exceeds the error threshold. Thus, the set of input audio objects is effectively replaced by a reduced number of audio objects (and optionally also at least one mixed speaker channel) based on the error threshold. The reduced number of audio objects typically comprises time-varying clusters of grouped (e.g., mixed) audio objects, wherein the clusters are formed by clustering spatially close and/or characteristically similar objects at defined (e.g., predetermined) time intervals or in response to object events.

Aspects of the invention include a system or device (e.g., a game console) configured (e.g., programmed) to implement any embodiment of the inventive method, and a computer readable medium (e.g., a disc) which stores code (e.g., in a non-transitory manner) for implementing any embodiment of the inventive method or steps thereof. For example, the inventive system can be or include a configurable game controller, or a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

In a class of embodiments, the invention is a game console configured to generate an object based audio program indicative of at least one audio object channel (typically a set of object channels) and at least one speaker channel (typically a set of speaker channels). Each audio object channel is indicative of an object or set (e.g., mix or cluster) of objects, and typically includes corresponding object-related metadata. The set of speaker channels may be a conventional mix (e.g., a 5.1 channel mix) of speaker channels of a type that might be included in a conventional speaker channel-based broadcast program which does not include an object channel. In response to an object based audio program generated by typical embodiments of the game console, a spatial rendering system (e.g., a subsystem of the game console, or a system external to the game console) may generate speaker feeds which are indicative of a mix of audio content of the speaker channels and each object channel. It is contemplated that, typically, the spatial rendering system is external to the game console and is operable with knowledge of the playback system speaker configuration to generate the speaker feeds such that the speaker feeds are indicative of an appropriate spatial mix of the program's speaker channel and object channel content.

Typical embodiments of the inventive system (e.g., game console) are configured to implement real-time creation of an encoded, object-based audio bitstream for transmission (or delivery in another manner) to an external rendering system (e.g., device). Typical embodiments of the inventive game console are configured to encode the bitstream in real-time, and to include object channels in (or remove object channels from) the bitstream without decoding the bitstream to the time domain.

NOTATION AND NOMENCLATURE

Figure 1:
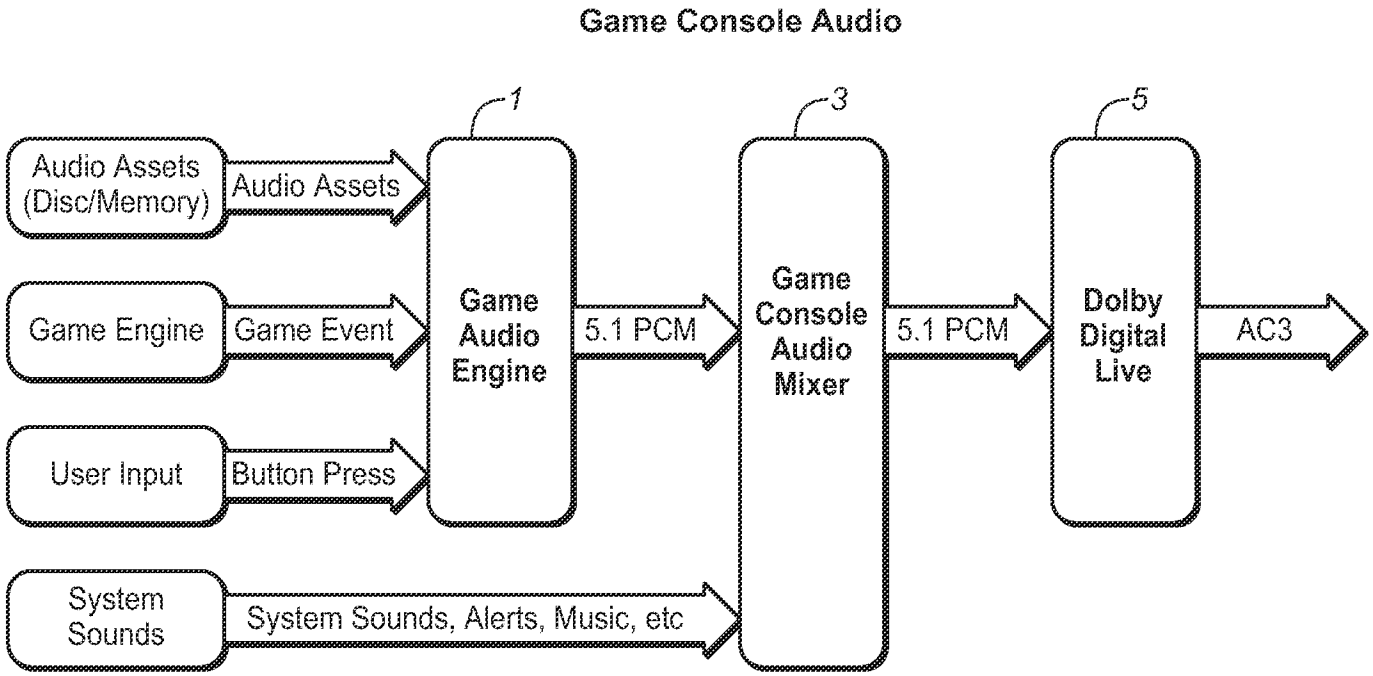
FIG. 1 (PRIOR ART)
FIG. 1 is a block diagram of a conventional game console.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the expression "audio video receiver" (or "AVR") denotes a receiver in a class of consumer electronics equipment used to control playback of audio and video content, for example in a home theater.

Throughout this disclosure including in the claims, the expression "soundbar" denotes a device which is a type of consumer electronics equipment (typically installed in a home theater system), and which includes at least one speaker (typically, at least two speakers) and a subsystem for rendering audio for playback by each included speaker (or for playback by each included speaker and at least one additional speaker external to the soundbar).

Throughout this disclosure including in the claims, the expressions "audio processor" and "audio processing unit" are used interchangeably, and in a broad sense, to denote a system configured to process audio data. Examples of audio processing units include, but are not limited to encoders (e.g., transcoders), decoders, codecs, pre-processing systems, post-processing systems, and bitstream processing systems (sometimes referred to as bitstream processing tools).

Throughout this disclosure including in the claims, the expression "metadata" (e.g., as in the expression "processing state metadata") refers to separate and different data from corresponding audio data (audio content of a bitstream which also includes metadata). Metadata is associated with audio data, and indicates at least one feature or characteristic of the audio data (e.g., what type(s) of processing have already been performed, or should be performed, on the audio data, or the trajectory of an object indicated by the audio data). The association of the metadata with the audio data is time-synchronous. Thus, present (most recently received or updated) metadata may indicate that the corresponding audio data contemporaneously has an indicated feature and/or comprises the results of an indicated type of audio data processing.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal. Such a signal can typically be rendered in such a way as to be equivalent to application of the signal directly to a loudspeaker at a desired or nominal position. The desired position can be static, as is typically the case with physical loudspeakers, or dynamic;

audio program: a set of one or more audio channels (at least one speaker channel and/or at least one object channel) and optionally also associated metadata (e.g., metadata that describes a desired spatial audio presentation);

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description (e.g., metadata indicative of the parametric audio source description is included in or provided with the object channel). The source description may determine sound emitted by the source (as a function of time), the apparent position (e.g., 3D spatial coordinates) of the source as a function of time, and optionally at least one additional parameter (e.g., apparent source size or width) characterizing the source;

object based audio program: an audio program comprising a set of one or more object channels (and optionally also comprising at least one speaker channel) and optionally also associated metadata (e.g., metadata indicative of a trajectory of an audio object which emits sound indicated by an object channel, or metadata otherwise indicative of a desired spatial audio presentation of sound indicated by an object channel, or metadata indicative of an identification of at least one audio object which is a source of sound indicated by an object channel); and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying the signal directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis.

DETAILED DESCRIPTION OF EMBODIMENTS OF THE INVENTION

Examples of embodiments of the inventive game console (and methods performed by the game console) will be described with reference to FIGS. 2, 3, and 4.

Figure 2:
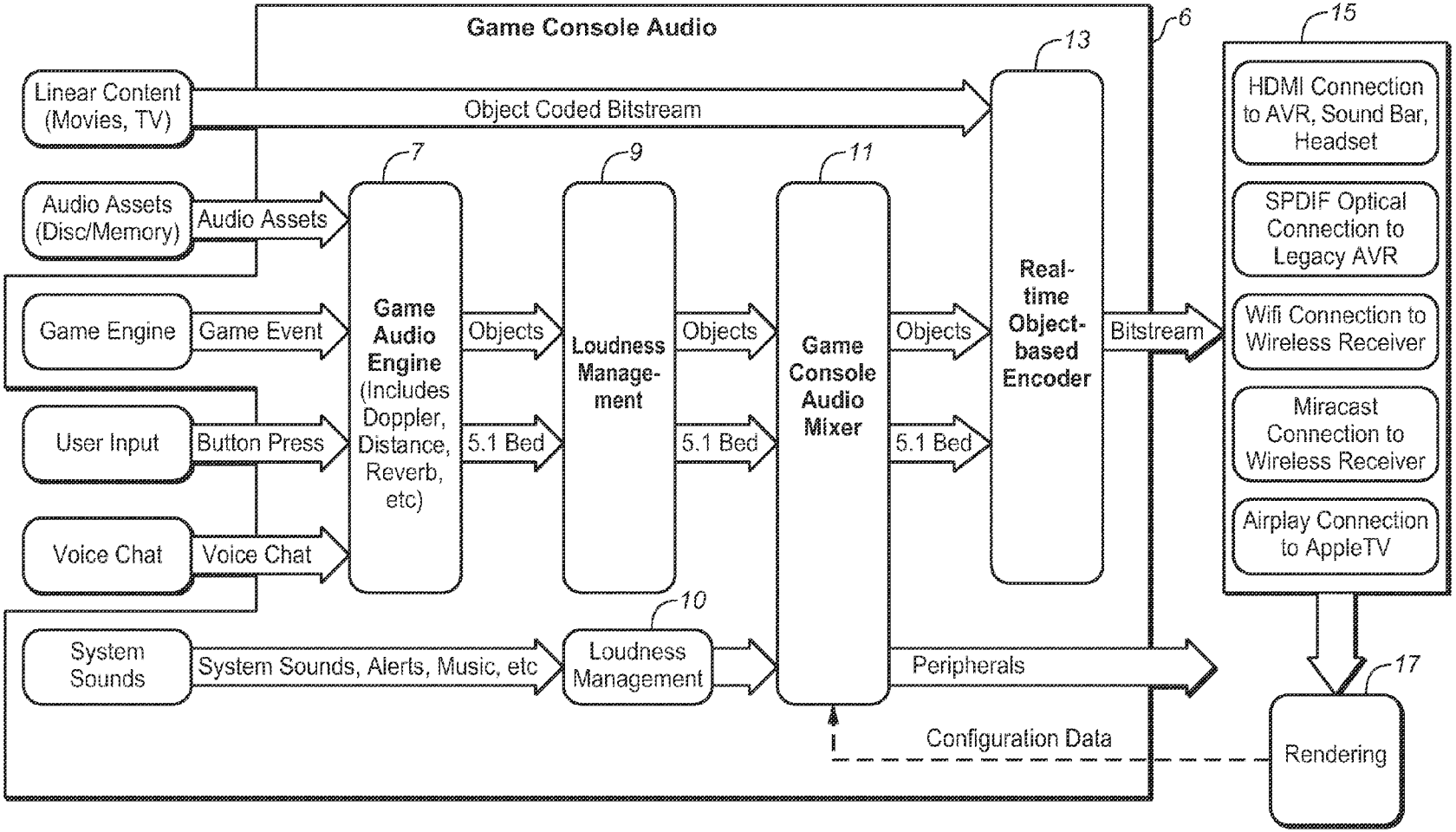
FIG. 2 is a block diagram of an embodiment of the inventive game console, and an audio program delivery system (system 15) and a rendering system (subsystem 17) external to the game console.

The FIG. 2 embodiment of the game console (game console 6) includes game audio engine 7, loudness management stage 9, loudness management stage 10, object-based audio mixer 11, and real-time, object-based encoder 13, connected as shown. These elements are typically implemented as (or in) an audio processing subsystem of game console 6, and the game console typically includes at least one other subsystem (e.g., for video game data processing) which is not shown in FIG. 2. The encoded audio program (an encoded audio bitstream) generated by encoder 13 is output to delivery subsystem 15. Delivery subsystem 15 is configured to store and/or transmit the encoded audio program.

Typically the encoded audio program is delivered (e.g., transmitted) by delivery system 15 to spatial rendering system 17. System 17 is configured to decode the encoded audio program and to generate (in response to the decoded audio) speaker feeds for driving speakers of a playback system.

Typically, rendering system 17 is implemented in (or as) a system or device which is distinct from game console 6. In examples of such embodiments, delivery system 15 may be an HDMI connection and system 17 may be implemented in an AVR, soundbar, or headset; or link 15 may be an SPDIF optical connection and system 17 may be implemented in a legacy AVR); or delivery system 15 may be a Wifi connection and system 17 may be implemented in a wireless receiver; or delivery system 15 may be a Miracast connection and system 17 may be implemented in a wireless receiver; or delivery system 15 may be an AirPlay connection and system 17 may be implemented in an Apple TV system.

The inputs to game audio engine 7 may include one or more of:

audio data (identified as "audio assets" in FIG. 2) which are typically indicative of accessed, encoded monophonic audio data files (or, optionally, encoded multi-channel audio data files). These files may be stored in a storage medium (e.g., a disc) accessible by game console 6, or may be otherwise accessed by game console 6 (e.g., via the internet or other network). Accesses to the audio assets are triggered by the game, so that the audio assets currently asserted (at any time during game play) to audio engine 7 are those most recently accessed by console 6;

game event data (which may be indicative of events during game play which in turn may select which individual audio data files are included in each set of audio assets currently asserted to audio engine 7);

user input data, indicative of user commands (e.g., entered by user actuation of a control device coupled to console 6) during game play, and which may in turn select which individual audio data files are included in each set of audio assets currently asserted to audio engine 7; and voice chat data (indicative of audio uttered by one or more players, typically during game play). The voice chat data may be asserted to console 6 from an external voice chat system (which may include a microphone coupled to console 6).

Game audio engine 7 is configured to manage the data input thereto, to monitor game state and user inputs, to play audio files determined by game events and user input, and to assert as output to loudness management stage 9 both a speaker channel-based mix (e.g., the 5.1 speaker channel PCM bitstream output from engine 7 as shown in FIG. 2), and object channel data (indicative of an audio object or set of audio objects, and corresponding object-related metadata). As indicated in FIG. 2, engine 7 may implement doppler, distance, and reverb processing on audio data input thereto.

System sounds (e.g., alerts and/or additional music and optionally other audio content), which are typically indicative of audio content not determined by game events or user inputs during game play, are separately asserted to loudness management stage 10.

Each of stages 9 and 10 is configured to implement real-time loudness management. The loudness management is preferably applied independently to the audio content from each source (e.g., stage 9 applies loudness management independently to each speaker channel and each object channel output from engine 7, and stage 10 is configured to treat each type of system sound input thereto as a separate audio object and to apply loudness management independently to each such object). Stage 9 thus outputs a modified speaker channel-based mix and modified object channel data, and stage 10 outputs modified additional audio content.

The modified speaker channel-based mix and modified object channel data (output from stage 9), and modified additional audio content (output from stage 10) are asserted to object based audio mixing subsystem 11. Typically, subsystem 11 treats each type of loudness-managed system sound input thereto from stage 10 as a separate audio object. Subsystem 11 determines a selected set of objects (and corresponding metadata) and speaker channels (in response to audio samples of the speaker channels and objects received from stage 9, audio samples of objects received from stage 10, and object related metadata received from stages 9 and 10). In response to the output of stage 11, and optionally also to linear audio content generated by (or asserted from an external source to) console 6, encoder 13 generates an object based encoded audio program (an encoded audio bitstream) indicative of a mix of speaker channels and object channels, and outputs this encoded audio bitstream to link 15. The linear audio content input to encoder 13 may be an object based audio program (e.g., a movie or TV program soundtrack) comprising one or more object channels and/or one or more speaker channels. Each speaker channel of the encoded audio program generated by encoder 13 may be indicative of one of the speaker channels input to encoder 13 (or it may be a mix of one such input speaker channel and other audio content). Each object channel of the encoded audio program may be indicative of one of the objects input to encoder 13 (or it may be a mix of audio content of two or more such objects).

Subsystem 11 is preferably implemented to determine one selected set of objects (and corresponding metadata) and speaker channels which is asserted to encoder 13, and also to determine at least one other selected set of objects (and corresponding metadata) and speaker channels which is asserted directly to a peripheral device (as indicated in FIG. 2). For example, with subsystem 11 so implemented, the inventive game console may operate to remove one or more objects from the mix which it sends to a peripheral device and include each such object in another mix which it sends to encoder 13 for encoding and delivery to the final renderer.

Subsystem 11 is typically configured to perform object clustering (described elsewhere herein) and object selection to generate the objects, object-related metadata, and speaker channel audio that it asserts to subsystem 13 (or to one or more peripheral devices). The object selection performed by subsystem 11 may be determined by user selection(s) and/or rules (e.g., indicative of conditions and/or constraints) which subsystem 11 has been programmed or otherwise configured to implement. Subsystem 11 is typically operable to mix audio content of one or more specific objects with audio content of specific speaker channels, to generate an output comprising a number (which does not exceed a predetermined maximum number) of objects as well as mixed speaker channels (into which audio content of one or more objects has been mixed). Subsystem 11 is typically also operable to mix audio content of different objects, to generate an output comprising a number (which does not exceed a predetermined maximum number) of objects (which may include at least one mixed object, indicative of audio content of one or more of the objects input to subsystem 11) and typically also speaker channels.

In response to the audio content (and metadata) determined by the output of subsystem 11, encoder 13 generates the object-based encoded audio bitstream such that the object-based encoded audio bitstream may be rendered (e.g., by system 17) for playback by speakers (not shown) of a playback system. Typically, the encoding implements compression, so that the object based program output from encoder 13 is a compressed audio bitstream.

Rendering system 17 is configured to map, to the available speaker channels of the playback system, the audio objects determined by the object channels selected by (and included in the encoded bitstream output from) subsystem 13, using rendering parameters (e.g., object-related metadata values, which may be indicative of level and spatial position or trajectory) which are associated with each selected object. At least some of these rendering parameters may be determined by the object related metadata included in the encoded bitstream output from subsystem 13. Rendering system 17 also receives a bed of speaker channels (i.e., at least one speaker channel) which has been included in the encoded bitstream output from subsystem 13. Typically, rendering system 17 is an intelligent mixer, and is configured to generate speaker feeds for the available speakers including by mapping one or more selected objects to each of a number of individual speaker channels, and mixing the objects with "bed" audio content indicated by each corresponding speaker channel of the speaker channel bed.

In a simplified embodiment of the inventive game console, audio objects and speaker channels (e.g., from game audio engine 7 of FIG. 2, or another game audio engine) are passed directly to an object-based audio encoder (e.g., encoder 13 of FIG. 2) without first going through other elements of the game console audio subsystem.

In another simplified embodiment of the inventive game console, audio objects and speaker channels (e.g., from game audio engine 7 of FIG. 2, or another game audio engine) are passed directly to a mixing subsystem (and then to a real-time object-based audio encoder) without first undergoing real-time loudness management. The FIG. 3 embodiment is an example of such a simplified embodiment. Game console 16 of FIG. 3 is identical to game console 6 of FIG. 2 except in that loudness management stages 9 and 10 (of console 6) are omitted from console 16. The description of the elements of the FIG. 2 system which are included in the FIG. 3 system will not be repeated with reference to FIG. 3. In the FIG. 3 embodiment, audio objects and speaker channels output from game audio engine 7 are asserted directly to mixing subsystem 11.

In another class of embodiments, the inventive game console is configured to play games of the typical type which contain a limited library of sounds which correspond to audio objects. In the case that each sound in the game's library is pre-encoded (i.e., has already been encoded at the time it is provided to the console with the game) in a format suitable for insertion (as an encoded object) into the encoded object based audio program generated by the console during game play, the console's encoder (e.g., encoder 13 of FIG. 2) is preferably configured to encode only speaker channels (e.g., those output from subsystem 13 of FIG. 2) indicative of game audio content, and metadata (e.g., object descriptions output from subsystem 13 of FIG. 2) indicative of encoded audio objects which are accessed from the game's library of sounds and optionally then modified in the console's mixer or loudness management subsystems (but not to encode the encoded audio objects themselves). Rather than encoding the pre-encoded objects (or modified versions of them) themselves, the encoder packages the speaker channels and metadata (which the encoder itself encodes), with the pre-encoded objects (or modified versions of them), into the final object based audio program which is output from the game console.

In some embodiments, the inventive game console is configured to manage limitations of (e.g., constraints on) delivery systems (e.g., system 15 of FIG. 2) and/or rendering systems that are coupled to the game console. For example, in some embodiments the game console implements an object clustering process which allows a rendering system (e.g., system 17 of FIG. 2, which is implemented as an audio video receiver, sound bar, or headset in some embodiments) to signal to the game console a maximum number of audio objects (in an encoded audio bitstream asserted to the rendering system) that the rendering system is compatible with, and in which the game console accordingly manages the number of audio objects that are included in the encoded, object based audio bitstream output from the game console. Similarly, the game console may be configured to manage the number of audio objects (e.g., limit the maximum number of such objects) included in the encoded, object based audio bitstream that it generates, in response to information regarding limitations (e.g., bandwidth or other capacity constraints) on a delivery system coupled between the game console and an intended rendering system. The game console preferably includes an object clustering subsystem configured to manage the number of objects that are encoded by the game console in the object based audio program output from the game console. For example, game audio engine 7 or processing subsystem 11 of the FIG. 2 embodiment of the inventive game console may be implemented to include such an object clustering subsystem. As indicated in FIG. 2 (and FIG. 3), rendering system 17 may be configured to assert configuration data (e.g., via delivery system 15, but not necessarily via delivery system 15) to subsystem 11. Such configuration data may be indicative of a maximum number of audio objects (in an encoded audio bitstream asserted to rendering system 17) with which rendering system 17 is compatible. In response to the configuration data, the object clustering subsystem of the game console (e.g., of subsystem 11) is configured to limit (as needed) the number of audio objects that are included in the encoded, object based audio program output from the game console.

In one exemplary embodiment, if the object clustering subsystem (e.g., included in an implementation of subsystem 11 of FIG. 2) is configured to assume (e.g., is notified that) a rendering system or transmission protocol can handle not more than 32 audio objects in an encoded bitstream, the object clustering subsystem may accept any number of audio objects (e.g., from subsystems 9 and 10 of FIG. 2), perform a real-time analysis thereon, and reduce the number of audio objects output from the object clustering subsystem (for inclusion in the encoded bitstream to be generated by encoder 13 of FIG. 2) to a number not greater than 32. Above-cited U.S. Provisional Patent Application No. 61/745,401, entitled "Scene Simplification and Object Clustering for Rendering Object-based Audio Content," describes embodiments of an object clustering system and method which may be implemented by embodiments of the present invention (e.g., the clustering system of FIG. 4, or an implementation of subsystem 11 of FIG. 2 or FIG. 3).

In some embodiments, an audio processing subsystem of the inventive game console is configured to signal to a game, or to at least one other element (e.g., a game configuration subsystem) of the game console, the maximum number of audio objects that may be included in an encoded audio bitstream to be generated by the game console. In response, the number of audio objects that are output to, or accessed during game play by, the game console's audio processing subsystem may be managed. For example, the object based audio program generated by the game console may include both a bed of speaker channels and a set of audio objects, and the maximum number of objects that can be accessed during game play may be limited (so as not to exceed a maximum number) by mixing some game audio content into the bed (before the bed is provided to the game console's audio processing subsystem) rather than providing it as separately accessible audio objects. This provides flexibility to game developers. Those developers that do not want to deal with audio object management can simply cause all objects to be accessible (e.g., by game audio engine 7 of FIG. 2) during game play and rely on an object clustering system of a game console (e.g., implemented by subsystem 11 of FIG. 2) to manage the maximum number of audio objects included in each object based audio program generated by the game console. Those developers that want to carefully manage the game audio mix can manage the number of accessible audio objects manually inside the game.

In some embodiments, the bed of speaker channels of the object based audio program generated in accordance with the invention is a 5.1 speaker channel bed. In other embodiments, the bed of speaker channels has another format (e.g., it may be a 7.1 or 9.1 speaker channel bed).

The object clustering system included in some embodiments of the inventive game console (e.g., an object clustering subsystem implemented in game audio engine 7 or processing subsystem 11 of FIG. 2) is configured to perform pre-processing on audio objects (e.g., to implement specific effects). For example, if object-related metadata associated with an audio object indicates that the object is indicative of sound emitting from a large (e.g., a very wide) source (i.e., sound which should be rendered so as to be perceived as sound emitting from a large source), the object clustering system may mix the audio content of the object with at least one speaker channel (thereby generating at least one mixed speaker channel indicative of audio content emitting from the object and other audio content), rather than causing the audio content to be included as an object channel in the encoded bitstream output from the game console. For another example, if object-related metadata associated with an audio object channel indicates that the object channel is indicative of reverberating sound (which should be rendered to be perceived as sound emitting from a very large source), the object clustering system may be configured either:

to mix audio content of the object channel with at least one speaker channel (thereby generating at least one mixed speaker channel indicative of the audio content of the object channel and other audio content), rather than causing the audio content of the object channel to be included as an object channel in the encoded program output from the game console; or to generate (e.g., by performing decorrelation processing audio content of the object channel) a "dry" audio object indicative of a dry (non-reverberating) version of the sound (which should be rendered to be perceived as sound emitting from a small source), and to cause the "dry" audio object to be included as an object channel in the encoded program output from the game console, and to generate audio content indicative of reverberations of the "dry" version of the sound (e.g., a part of the original reverberating sound which is decorrelated from the "dry" version of the original reverberating sound) and mix such generated audio content with at least one speaker channel (thereby generating at least one mixed speaker channel indicative of reverberations of the "dry" sound indicated by the "dry" audio object channel). Thus, a decorrelated part of the original reverberating sound (indicative of reverberations) would be generated and added to bed speaker channels while the dry (non-reverberating) part of the object channel's content would persist as an audio object. Alternatively, the audio content indicative of reverberations of the "dry" sound (i.e., the decorrelated component) can be pre-rendered to a bed (or virtual bed) of speaker feeds, and each such bed (or virtual bed) can then be treated as an object and clustered with all the other objects.

Conventional game audio engines (e.g., audio engine 1 of FIG. 1) often include speaker channel-based renderers having a very mature design. In a preferred embodiment of the inventive game console, the console's game audio engine (e.g., engine 7 of FIG. 2 or FIG. 3) has a conventional design (or differs only in minor respects from a conventional game audio engine), thus avoiding the need for a complete redesign of this subsystem of the console. For example, game audio engine 7 of the FIG. 3 embodiment of the console may be implemented to pass through audio objects asserted thereto (and otherwise to have conventional design), and subsystem 11 of the FIG. 3 embodiment may be configured to implement object clustering (in response to the audio objects and speaker channels asserted thereto (including audio objects passed through engine 7 to subsystem 11) and to output (to encoder 13) a set of object channels and a bed of speaker channels for encoding as an object based audio program. The object based program generated by encoder 13 would typically include a bed of speaker channels as well as audio objects and object-related metadata. Such an implementation of the inventive game console would allow game developers to assume that the console will include a game audio engine which generates a bed of speaker channels in a conventional manner, and that the console will also include (with the speaker channel bed) a set of audio objects and object-related metadata in the encoded object based audio program output from the game console.

In a preferred embodiment, the inventive game console includes a real-time encoder (e.g., a real-time encoding implementation of encoder 13 of FIG. 2) configured to accept a set of speaker channels, a set of audio objects, and object-related metadata. Preferably, the audio objects and speaker channels are indicative of audio content output determined by game play and also audio content from at least one other audio source in (or coupled to) the console. For example, such other audio source may be a voice chat system, coupled to the game console and configured to provide voice chat data (as indicated in FIGS. 2 and 3) which the console includes in the speaker channels and/or object channels provided to the console's encoder.

Figure 3:
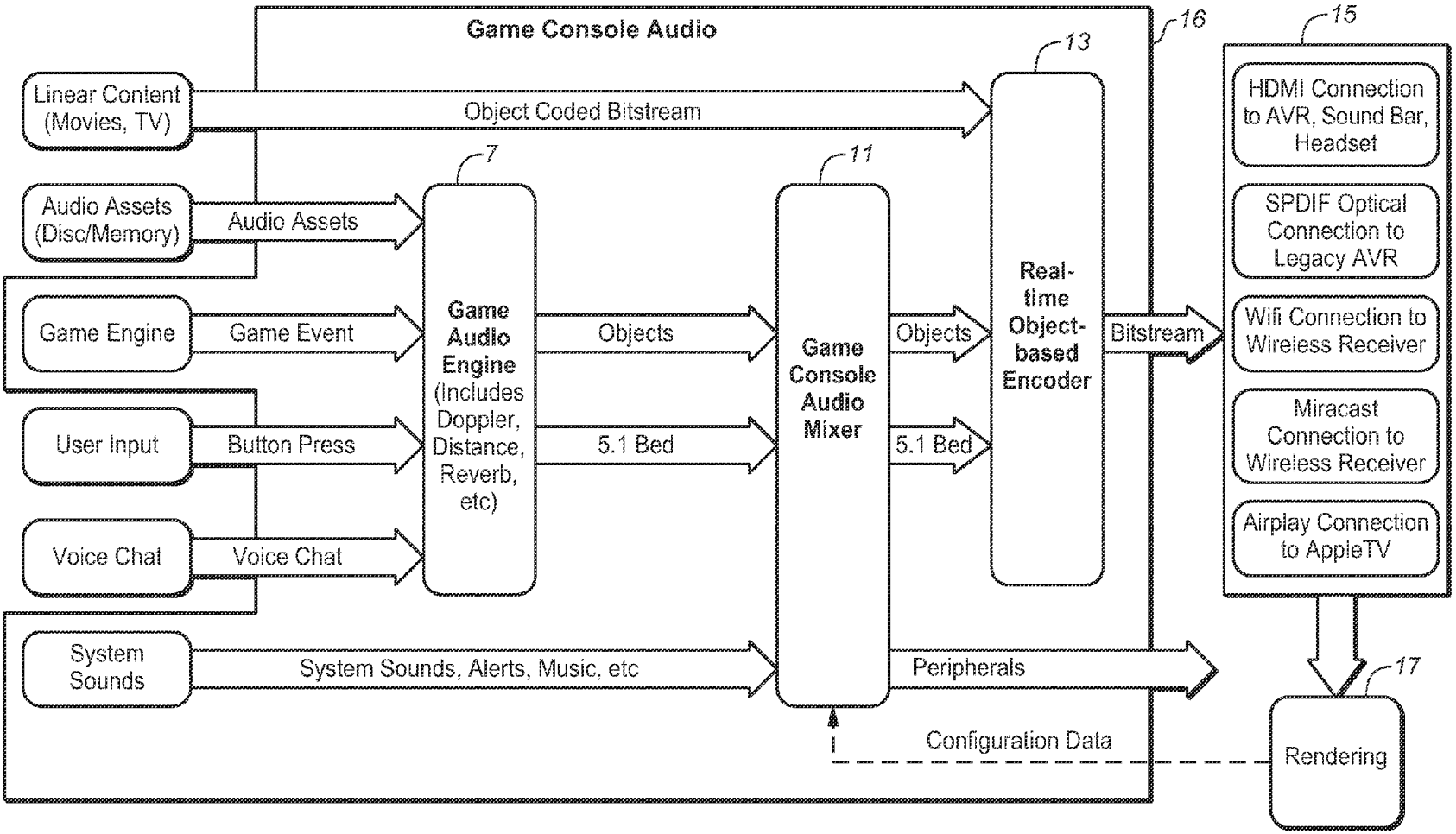
FIG. 3 is a block diagram of another embodiment of the inventive game console, and an audio program delivery system (system 15) and a rendering system (subsystem 17) external to the game console.

In some embodiments, the inventive game console is configured to make decisions about whether non-game audio (e.g., system sounds and/or voice chat data of the type indicated in FIGS. 2 and 3) are encoded as audio objects or mixed into one or more speaker channels. In some embodiments, the game console is configured to include objects in (e.g., inject objects into) and/or remove objects from an encoded object based program generated by the game console (e.g., for output from the game console), without performing a full decode, mix, and re-encode of the encoded program. For example, the game console may be configured (as are the FIG. 2 and FIG. 3 systems) to include in an encoded object based program a system sound (e.g., an alert) or voice chat content as an object channel of an object based audio program generated by encoder 13 (such that when the program is rendered, the system sound or voice chat content will be superimposed over the other audio content of the program), without performing a decode, mix, and re-encode of the program. For another example, encoder 13 of the FIG. 2 or FIG. 3 system may be configured to combine content of one or more object channels of an object based audio program (e.g., object channels of an object based audio program, indicative of linear audio content, asserted to encoder 13 as indicated in FIGS. 2 and 3, or system sound or voice chat content of one or more object channels of an object based audio program asserted to encoder 13) with an encoded object based audio program generated in encoder 13 (e.g., a program generated in encoder 13 in response to objects and speaker channel content received from subsystem 11). For example, voice chat content could be included (e.g., injected) as an object with a specific location that is user controllable. In some embodiments, the inventive game console's injection of objects into (or removal of objects from) an encoded object based program generated by the game console, without performing a full decode, mix, and re-encode of the encoded program, is performed in any of the ways (or by any of the systems or apparatus) disclosed in U.S. Provisional Patent Application No. 61/696,073, filed on Aug. 31, 2012, entitled "Processing Audio Objects in Principal and Supplementary Encoded Audio Signals," naming Stephen Spencer Hooks and Freddie Sanchez as inventors, and assigned to the assignee of the present invention, the full text and disclosure of which application is incorporated herein by reference.

In a class of embodiments, the invention is a method (typically performed by a game console) for generating an object based audio program indicative of game audio content (audio content pertaining to play of or events in a game, and optionally also other information regarding the game). The program includes at least one object channel and at least one speaker channel (e.g., a set or "bed") of speaker channels. Each object channel is indicative of an audio object or set (e.g., mix or cluster) of audio objects, and typically includes corresponding object-related metadata. The bed of speaker channels may be a conventional mix (e.g., a 5.1 channel mix) of speaker channels of a type that might be included in a conventional speaker channel-based broadcast program which does not include an object channel.

In typical embodiments, the object based audio program includes at least one audio object channel and at least one speaker channel, and the method includes steps of:

determining at least one audio object channel (e.g., generating audio data indicative of each said audio object channel), wherein each said audio object channel is indicative of at least one audio object, and at least one said audio object channel is indicative of game audio content;

determining at least one speaker channel (e.g., generating audio data indicative of each said speaker channel), wherein at least one said speaker channel is indicative of game audio content; and generating the object based audio program, including by encoding data indicative of each said audio object channel and each said speaker channel.

Typically, the method includes a step of operating a game console to play a game, including by accessing data indicative of at least one said audio object, and each of the determining and generating steps is performed by the game console during play of the game.

In some embodiments, the object based audio program is an AC-3 or E-AC-3 bitstream. In response to an object based audio program generated by typical embodiments in this class, a spatial rendering system (e.g., a subsystem of the game console, or a system external to the game console) may generate speaker feeds which are indicative of a mix of audio content of each speaker channel and each object channel. It is contemplated that the inventive method is typically performed by a game console, and that the spatial rendering system is typically external to the game console and is operable with knowledge of the playback system speaker configuration to generate the speaker feeds such that the speaker feeds are indicative of an appropriate spatial mix of the program's speaker channel and object channel content.

In some embodiments, the inventive method includes steps of:

(a) identifying a set of input audio objects which are indicative of game audio content (audio content pertaining to play of or events in a game, and optionally also other information regarding the game) to be included in the object based audio program, where the set consists of N input audio objects, and N is greater than one;

(b) replacing the set of input audio objects (e.g., by mixing audio content of at least one audio object of the set) with a reduced set of audio objects (and optionally also at least one mixed speaker channel), where the reduced set consists of M audio objects, and M is a positive integer less than N; and (c) generating the object based audio program such that said object based audio program is indicative of the reduced set of audio objects, includes only M object channels, and includes at least one speaker channel.

For example, step (a) may be performed by game audio engine 7 of FIG. 2 (or FIG. 3), and step (b) may be performed by audio mixer 13 of FIG. 2 (or FIG. 3).

Step (b) may include one or both of the steps of:

mixing audio content of at least two of the input audio objects to generate at least one clustered audio object; or mixing audio content of at least one of the input audio objects with audio content of a speaker channel to generate at least one mixed speaker channel.

In some embodiments, step (b) includes steps of defining an error threshold for at least one parameter indicated by metadata associated with each audio object of the set of input audio objects, and identifying as one of the reduced set of audio objects (and thus mixing audio content of) each audio object of the set which is associated with metadata for which the at least one parameter exceeds the error threshold. Thus, the set of input audio objects is effectively replaced by a reduced number of audio objects (and optionally also at least one mixed speaker channel) based on the error threshold. The reduced number of audio objects typically comprises time-varying clusters of grouped (e.g., mixed) audio objects, wherein the clusters are formed by clustering spatially close and/or characteristically similar objects at defined (e.g., predetermined) time intervals or in response to object events.

In typical embodiments, the inventive method performs (and an object clustering subsystem of the inventive game console is configured to perform) clustering operations that reduce the number of individual audio objects to be delivered (as part of an object based audio program) to a rendering system, while still allowing the program to include enough spatial information so that (after rendering and playback) the perceived difference between the program content determined by the inputs to the object clustering subsystem (or step) and the program content determined by the outputs from the object clustering subsystem (or step) is minimized.

In various embodiments of the invention, the object-related metadata which corresponds to each object channel of an object based audio program defines characteristics of associated audio object content (e.g., object spatial position as a function of time, content type, loudness, and so on). In general, any practical number of audio objects (e.g., hundreds of objects) may be processed through the inventive system (for playback) and included in a generated object based audio program. To facilitate accurate playback of these objects (which may comprise a large number of objects) in a wide variety of playback systems and transmission media, the inventive method and game console may implement or include an object clustering process or component that reduces an initial number of original objects into a smaller more manageable number of objects (for inclusion in the object based audio program), e.g., by combining the original objects into a smaller number of object groups. The clustering process may build clusters (groups) of objects to produce a smaller number of output clusters (mixed or otherwise clustered objects) from an original set of individual input objects. Typically, the clustering process or component processes object-related metadata of the input objects as well as the audio object content itself to produce the reduced number of objects (e.g., clustered objects). Typically, the metadata is analyzed to determine which objects at any point in time are most appropriately combined with other objects (or with speaker channels), and the corresponding audio waveforms for the combined objects may then be summed together to produce a substitute or combined object. The combined object groups are then input to the encoder (e.g., encoder 13 of FIG. 2) which generates the object based program.

In typical embodiments, the object clustering method facilitates the delivery and/or rendering of object channel and speaker channel content in reduced bandwidth channels or coding systems, and uses information about audio objects (including one or more of spatial position, temporal attributes, content type, width, and/or other appropriate characteristics) to dynamically cluster objects so as to reduce the number of objects included in an output audio program. This process can reduce the number of objects included in the program by performing one or both of the following clustering operations: clustering of object(s) with at least one object, and/or clustering of object(s) with at least one speaker channel. Optionally, an object can be distributed over two or more clusters. The clustering process typically utilizes an error metric based on distortion due to a change (resulting from clustering) in location, loudness or other characteristic of clustered objects to determine an optimum tradeoff between clustering compression versus sound degradation of the clustered objects. The clustering process can be performed synchronously or it can be event-driven, such as by using auditory scene analysis (ASA) and event boundary detection to control object simplification through clustering. In some embodiments, the process may utilize knowledge of endpoint rendering algorithms and devices to control clustering. In this way, certain characteristics or properties of the playback system may be used to inform the clustering process. For example, different clustering schemes may be utilized for speakers versus headphones or other audio drivers, or different clustering schemes may by utilized for lossless versus lossy coding, and so on.

Herein, the terms 'clustering' and 'grouping' or 'combining' are used interchangeably to describe the combination of objects and/or speaker channels to reduce the amount of data in a unit of audio content (e.g., a frame or other segment of an encoded object based audio program) for delivery (e.g., transmission) to and rendering in an audio playback system; and the terms 'compression' or 'reduction' may be used to refer to the act of performing scene simplification of audio through such clustering of objects and/or speaker channels. The terms 'clustering', 'grouping' or 'combining' herein are not limited to a unique assignment of an object or speaker channel to a single cluster only. Instead, an object or speaker channel may be clustered by being distributed over more than one output speaker channel or object cluster (e.g., using weights or gain vectors that determine the relative contribution of an object or speaker channel signal to the output cluster or output speaker channel signal).

Figure 4:
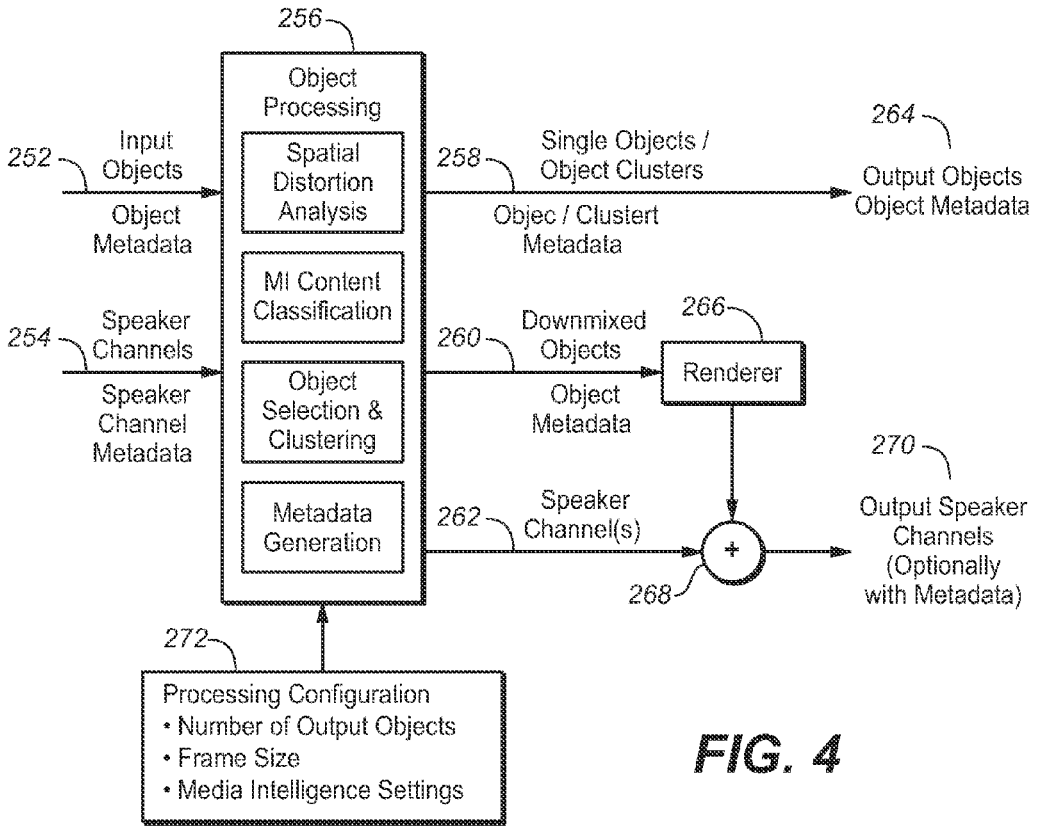
FIG. 4 is a block diagram of an embodiment of an audio object clustering system (e.g., a subsystem of an embodiment of the inventive game console).

FIG. 4 is a diagram of an embodiment of an audio object clustering system (e.g., a subsystem of an embodiment of the inventive game console). As shown in FIG. 4, object processing component 256 is configured to perform scene simplification tasks to be described. In operation, component 256 reads in an arbitrary number (to be referred to as "X") of input audio objects 252 indicative of game audio content and typically also corresponding object-related metadata (e.g., audio object files of the type input to game audio engine 7 of FIG. 2 during game play), and an arbitrary number of speaker channels 254 (also indicative of game audio content) and optionally also associated speaker channel bed metadata. Object processing component 256 performs media intelligence/content classification, spatial distortion analysis, and object selection/clustering to generate output indicative of speaker channel(s) and a smaller number of output objects ("Y" output objects, where Y is less than X). The output objects 258 can include new objects (identical or equivalent to input objects) and/or object clusters (e.g., mixes of input objects), with associated object/cluster metadata. One or more of the input objects can be selected for downmixing into one or more speaker channels. Such selected objects (which are indicated as downmixed objects 260 in FIG. 4) are asserted from component 256 to renderer 266 for rendering into format suitable for combination (mixing) in element 268 with speaker channel(s) 262 to generate output speaker channel(s) 270 and optionally also associated metadata. The configuration (number and format) of output speaker channel(s) 270 (e.g., a typical 5.1 speaker channel configuration for playback on a typical home playback system) need not match the configuration of input speaker channel(s) 254, which for example could be a 9.1 speaker channel configuration. New speaker channel metadata may be generated (in component 256 and/or renderer 266) for the output speaker channel(s) including by combining metadata from the input speaker channel(s). New audio data of the output speaker channel(s) is generated (in elements 266 and 268) by combining audio from at least one input speaker channel and at least one downmixed object 260.

Object processing component 256 utilizes certain processing configuration information 272. In an embodiment, these include the number of output objects, the frame size and certain media intelligence settings. Media intelligence can include several parameters or characteristics associated with the objects, such as content type (i.e., dialog/music/effects/etc.), regions (segment/classification), preprocessing results, auditory scene analysis results, and other similar information.

In an alternative embodiment, audio generation (of the type performed in elements 266 and 268) is deferred by keeping (and outputting) a reference to all original channels (downmixed object channels and speaker channels) as well simplification metadata (e.g., which objects belongs to which cluster, which objects are to be rendered to beds, etc.). This can be useful to distribute the clustering process between a game console (which may include component 256) and an external device or system (which may receive the outputs of component 256).

The object related metadata included with objects 258 and/or 260 may be indicative of: object position, object size (e.g., width), audio content type, loudness, rendering modes, control signals, among other possible metadata types. The metadata definitions may include elements that define certain values associated with each metadata type. When two or more objects are combined together during a clustering process, their respective metadata elements are typically combined through a defined combination scheme (e.g., a weighted average to derive position and width of the combined object). With respect to position, the geometric center of a centroid encompassing the clustered (constituent) objects can be used to represent the position of the replacement object.

The loudness of a combined object may be derived by averaging or summing the loudness of the constituent objects. In an embodiment, the loudness metric of a signal represents the perceptual energy of the signal, which is a measure of the energy that is weighted based on frequency. Loudness is thus a spectrally weighted energy that corresponds to a listener's perception of the sound. In an alternative embodiment, instead of, or along with loudness, the process may use the pure energy (RMS energy) of the signal, or some other measure of signal energy as a factor in determining the importance of an object. In yet an alternative embodiment, the loudness of the combined object is derived from the partial loudness data of the clustered objects, in which the partial loudness represents the (relative) loudness of an object in the context of the complete set of objects and beds according to psychoacoustic principles. Thus, the loudness metadata type may be embodied as an absolute loudness, a partial loudness or a combined loudness metadata definition. Partial loudness (or relative importance) of an object can be used for clustering as an importance metric, or as means to selectively render objects if the rendering system does not have sufficient capabilities to render all objects individually.

One example of clustering of objects is to group objects that are spatially related, i.e., to combine objects that are located in a similar spatial position, wherein the similarity of the spatial position is defined by a maximum error threshold based on distortion due to shifting constituent objects to a position defined by the replacement cluster.

A second clustering scheme determines when it is appropriate to combine audio objects that may be spatially diverse with speaker channels that represent fixed spatial locations. An example of this type of clustering is when there is not enough available bandwidth to transmit an object that may be originally represented as traversing in a three dimensional space, and instead to mix the object into its projection onto the horizontal plane, which is where speaker channel are typically represented. This allows one or more objects to be dynamically mixed into static speaker channels, thereby reducing the number of objects that need to be transmitted.

A third clustering scheme uses prior knowledge of certain known system characteristics. For example, knowledge of endpoint rendering algorithms and/or reproduction devices in the playback system may be used to control the clustering process. For example, a typical home theater configuration relies on physical speakers located in fixed locations. These systems may also rely on speaker virtualization algorithms that compensate for the absence of some speakers in the room and use algorithms to give the listener virtual speakers that exist within the room. If information such as the spatial diversity of the speakers and the accuracy of virtualization algorithms is known, then it may be possible to send a reduced number of objects because the speaker configuration and virtualization algorithms can only provide a limited perceptual experience to a listener. In this case, sending a full speaker channel bed plus object representation may be a waste of bandwidth, so some degree of clustering would be appropriate. Other types of known information could also be used in this clustering scheme, such as the content type of the object or objects to control clustering, or the width of an object or objects to control clustering.

A fourth clustering scheme comprises the use of temporal information to control the dynamic clustering and de-clustering of objects. In one embodiment, the clustering process is performed at regular intervals or periods (e.g., once every 10 milliseconds). Alternatively, other temporal events can be used, including techniques such as auditory scene analysis (ASA) and auditory event boundary detection to analyze and process the audio content to determine the optimum clustering configurations based on the duration of individual objects.

In an embodiment, the clustering process dynamically groups an original number of audio objects and speaker channels into a target number of new equivalent objects and speaker channels. In most practical applications, the target number is substantially lower than the original number, e.g., 100 original input channels combined into 20 or fewer combined groups.

In an embodiment, the clustering process involves analyzing the audio content of every individual input (object or speaker) channel as well as corresponding metadata (e.g., the spatial position of the objects) to derive an equivalent number of output object/speaker channels that minimizes a given error metric. In one implementation, the error metric is based on the spatial distortion due to shifting the clustered objects and can further be weighted by a measure of the importance of each object over time. The importance of an object can encapsulate other characteristics of the object, such as loudness, content type, and other relevant factors. Alternatively, these other factors can form separate error metrics that can be combined with the spatial error metric.

In an embodiment, the clustering process supports objects with a width or spread parameter. Width is used for objects that are not rendered as pinpoint sources but rather as sounds with an apparent spatial extent. As the width parameter increases, the rendered sound becomes more spatially diffuse and consequently, its specific location becomes less relevant. It is thus advantageous to include width in the clustering distortion metric so that it favors more positional error as the width increases.

The clustering process typically combines objects into clusters based on certain characteristics of the objects and a defined amount of error that cannot be exceeded. The clustering process typically dynamically recomputes the output object groups to constantly build object groups at different or periodic time intervals to optimize object grouping on a temporal basis. In one embodiment, the clustering process analyzes input objects and performs clustering at regular periodic intervals, such as once every 10 milliseconds, or any other appropriate time period. Various input objects can exist in different locations at any one point in time, and the objects can be of different widths. The clustering process analyzes the input objects to form groups of objects that are spatially close enough together relative to a defined maximum error threshold value. Objects that separated from one another within a distance defined by the error threshold at one time may be eligible to be clustered together.

Instead of performing clustering periodically, the clustering process may cluster objects based on a trigger condition or event associated with input objects. One such trigger condition is the start and stop times for each input object.

Embodiments of the invention may be implemented in hardware, firmware, or software, or a combination thereof (e.g., as a programmable logic array). For example, the system of FIG. 2, FIG. 3, or FIG. 4 may be implemented in appropriately programmed (or otherwise configured) hardware or firmware, e.g., as a programmed general purpose processor, digital signal processor, or microprocessor (or a game controller including such an appropriately configured general purpose processor, digital signal processor, or microprocessor). Unless otherwise specified, the algorithms or processes included as part of the invention are not inherently related to any particular computer, game controller, or other apparatus. In particular, various general-purpose machines may be used with programs written in accordance with the teachings herein, or it may be more convenient to construct more specialized apparatus (e.g., integrated circuits, or game controllers including specialized circuits) to perform the required method steps. Thus, the invention may be implemented in one or more computer programs executing on one or more programmable computer systems (e.g., a computer system which implements the game controller of FIG. 2, FIG. 3, or FIG. 4), each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing) a computer program, where the storage medium so configured causes a computer system to operate in a specific and predefined manner to perform the functions described herein.

While implementations have been described by way of example and in terms of exemplary specific embodiments, it is to be understood that implementations of the invention are not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A method for generating an object based audio program indicative of game audio content, said method including steps of:

(a) determining at least one audio object channel, wherein each said audio object channel is indicative of at least one audio object, and at least one said audio object channel is indicative of game audio content;

(b) determining at least one speaker channel, said at least one speaker channel being associated with a first speaker configuration, wherein at least one said speaker channel is indicative of additional game audio content; and (c) generating the object based audio program, including by encoding data indicative of each said audio object channel and each said speaker channel, wherein step (a) includes steps of:

(d) identifying a set of input audio objects which are indicative of game audio content, where the set consists of N audio objects and N is a positive integer; and (e) replacing the set of input audio objects with a reduced set of audio objects, where the reduced set consists of M audio objects, M is a positive integer less than N and said at least one audio object channel is indicative of the reduced set of audio objects, and wherein step (c) includes the step of:

generating the object based audio program such that said object based audio program is indicative of the reduced set of audio objects, and includes M object channels and at least one speaker channel associated with a second speaker configuration, the second speaker configuration being different from the first speaker configuration.

2. The method of claim 1, also including a step of operating a game console to play a game, including by accessing data indicative of at least one said audio objects, and wherein steps (a), (b), and (c) are performed by the game console during play of the game.

3. The method of claim 2, also including a step of:

asserting configuration data to the game console, and wherein said step of performing object clustering is in response to the configuration data to determine a limited number of audio object channels to be included in the object based audio program.

4. The method of claim 2, wherein object-related metadata associated with an input object channel indicates that the input object channel is indicative of reverberating sound and/or sound emitting from a large source, wherein step (b) includes said step of performing object clustering, and wherein said step of object clustering is performed in response to the object-related metadata to mix audio content of said input object channel with audio content of at least one input speaker channel to determine at least one said speaker channel.

5. The method of claim 2, wherein object-related metadata associated with an input object channel indicates that the input object channel is indicative of reverberating sound, and wherein steps (a) and (b) includes steps of:

in response to the object-related metadata, determining a dry version of the reverberating sound, and generating audio content indicative of reverberations of the dry version of the reverberating sound;

determining one said audio object channel which is indicative of the dry version of the reverberating sound; and determining at least one said speaker channel which is indicative of reverberations of the dry version of the reverberating sound.

6. The method of claim 1, also including the step of:

in response to the object based audio program, operating a spatial rendering system to generate speaker feeds indicative of a mix of audio content of each said speaker channel and each said audio object channel.

7. The method of claim 1, wherein step (e) includes the step of:

mixing audio content of at least two of the input audio objects to generate at least one clustered audio object.

8. The method of claim 1, wherein step (e) includes the step of:

mixing audio content of at least one of the input audio objects with audio content of a speaker channel to generate at least one mixed speaker channel.

9. The method of claim 1, wherein step (e) includes steps of:

defining an error threshold for at least one parameter indicated by metadata associated with each of the set of input audio objects; and identifying as one of the reduced set of audio objects each of the input audio objects which is associated with metadata for which the at least one parameter exceeds the error threshold.

10. The method of claim 1, also including a step of:

generating an additional object based audio program in response to the object based audio program and additional audio content indicative of at least one additional object, including by including the additional audio content in the additional object based audio program, as at least one additional object channel of said additional object based audio program, without performing a full decode, mix, and re-encode of the object based audio program.

11. A game console configured to generate an object based audio program indicative of game audio content, said game console including:

a first subsystem configured to determine at least one audio object channel and at least one speaker channel, wherein each said audio object channel is indicative of at least one audio object, at least one said audio object channel is indicative of game audio content, said at least one speaker channel is associated with a first speaker configuration and said at least one said speaker channel is indicative of additional game audio content; and an encoding subsystem coupled to the first subsystem and configured to generate the object based audio program, including by encoding data indicative of each said audio object channel and each said speaker channel, wherein the first subsystem is configured to:

identify a set of input audio objects which are indicative of game audio content, where the set consists of N audio objects and N is a positive integer; and replace the set of input audio objects with a reduced set of audio objects, where the reduced set consists of M audio objects, M is a positive integer less than N, and said at least one audio object channel is indicative of the reduced set of audio objects, and wherein the encoding subsystem is configured to generate the object based audio program such that said object based audio program is indicative of the reduced set of audio objects, and includes M object channels and at least one speaker channel associated with a second speaker configuration, the second speaker configuration being different from the first speaker configuration.

12. The game console of claim 11, wherein said game console is configured to play a game, including by accessing data indicative of at least one said audio object, and wherein the first subsystem is configured to determine each said audio object channel and each said speaker channel during play of the game, and the encoding subsystem is configured to generate the object based audio program during play of said game.

13. The console of claim 11, wherein the first subsystem is configured to perform said object clustering to determine, in response to configuration data asserted to the console, a limited number of audio object channels to be included in the object based audio program.

14. The console of claim 11, wherein object-related metadata associated with an input object channel indicates that the input object channel is indicative of reverberating sound and/or sound emitting from a large source, and wherein the first subsystem is configured to perform said object clustering, in response to the object-related metadata, to mix audio content of said input object channel with audio content of at least one input speaker channel to determine at least one said speaker channel.

15. The console of claim 11, wherein object-related metadata associated with an input object channel indicates that the input object channel is indicative of reverberating sound, and wherein the first subsystem is configured to perform object clustering, including by:

in response to the object-related metadata, determining a dry version of the reverberating sound, and generating audio content indicative of reverberations of the dry version of the reverberating sound;

determining one said audio object channel which is indicative of the dry version of the reverberating sound; and determining at least one said speaker channel which is indicative of reverberations of the dry version of the reverberating sound.

16. The console of claim 11, wherein the first subsystem is configured to mix audio content of at least two of the input audio objects to generate at least one clustered audio object.

17. The console of claim 11, wherein the first subsystem is configured to mix audio content of at least one of the input audio objects with audio content of a speaker channel to generate at least one mixed speaker channel.

18. The console of claim 11, wherein the first subsystem is configured to:

determine an error threshold for at least one parameter indicated by metadata associated with each of the set of input audio objects; and identify as one of the reduced set of audio objects each of the input audio objects which is associated with metadata for which the at least one parameter exceeds the error threshold.

19. The console of claim 11 wherein the encoding subsystem is also configured to generate an additional object based audio program in response to the object based audio program and additional audio content indicative of at least one additional object, including by including the additional audio content in the additional object based audio program, as at least one additional object channel of said additional object based audio program, without performing a full decode, mix, and re-encode of the object based audio program.

20. A non-transitory storage medium recording a program of instructions that is executable by a device for performing a method for generating an object based audio program indicative of game audio content, said method including steps of:

(a) determining at least one audio object channel, wherein each said audio object channel is indicative of at least one audio object, and at least one said audio object channel is indicative of game audio content;

(b) determining at least one speaker channel, said at least one speaker channel being associated with a first speaker configuration, wherein at least one said speaker channel is indicative of additional game audio content; and (c) generating the object based audio program, including by encoding data indicative of each said audio object channel and each said speaker channel, wherein step (a) includes steps of:

(d) identifying a set of input audio objects which are indicative of game audio content, where the set consists of N audio objects and N is a positive integer; and (e) replacing the set of input audio objects with a reduced set of audio objects, where the reduced set consists of M audio objects, M is a positive integer less than N and said at least one audio object channel is indicative of the reduced set of audio objects, and wherein step (c) includes the step of:

generating the object based audio program such that said object based audio program is indicative of the reduced set of audio objects, and includes M object channels and at least one speaker channel associated with a second speaker configuration, the second speaker configuration being different from the first speaker configuration.

* * * * *